United States Patent [19]

Harada

[11] 4,041,258

[45] Aug. 9, 1977

[54] SWITCH HAVING UNIVERSAL TYPE ACTUATOR AND GUIDE PLATE

[75] Inventor: Shinichi Harada, Tokyo, Japan

[73] Assignee: Niles Parts Company, Limited, Tokyo, Japan

[21] Appl. No.: 692,123

[22] Filed: June 2, 1976

Related U.S. Application Data

[63] Continuation-in-part of Ser. No. 565,001, April 4, 1975, abandoned.

[30] Foreign Application Priority Data

Apr. 27, 1974 Japan ..... 49-47588

[51] Int. Cl.[2] ..... H01H 25/04; H01H 15/00

[52] U.S. Cl. ..... 200/6 A; 200/16 C

[58] Field of Search ..... 200/6 A, 16 C, 336, 200/335, 339

[56] References Cited

U.S. PATENT DOCUMENTS

| | | | |
|---|---|---|---|
| 3,299,227 | 1/1967 | Schaad et al. | 200/16 C |
| 3,500,003 | 3/1970 | Schink | 200/16 C |
| 3,604,863 | 9/1971 | Schink | 200/16 C |
| 3,814,871 | 6/1974 | Osika | 200/6 A |
| 3,898,397 | 8/1975 | DeVore et al. | 200/6 A |
| 3,927,285 | 12/1975 | Frost et al. | 200/6 A |

*Primary Examiner*—James R. Scott

*Attorney, Agent, or Firm*—Gifford, Chandler, Sheridan & Sprinkle

[57] ABSTRACT

A four-way lever switch which can occupy four different switching positions by moving the shift lever and which upon release of the shift lever, it and its appertaining parts at once return to their neutral positions. In the switch, a block carrying movable contacts moves on stationary contacts arranged on the base of the housing and its movements are guided by a plate mounted on the block. The guide plate is provided with an oblong aperture in which a hollow cube formed integrally with the block is movably inserted. The block moves laterally along the oblong aperture while the guide plate remains stationary. The guide plate moves only when the block is shifted in the direction perpendicular to the oblong aperture. By means of the guide plate, the movements of the contact carrying block are correctly conducted and no disturbance in the relative positions between the stationary and the movable contacts occurs. This switch is a quick action switch adapted to be used as a controller for automobile fender mirror adjuster, electric signal devices, various electric toys or as remote controller for radio controlled toy aeroplanes.

2 Claims, 8 Drawing Figures

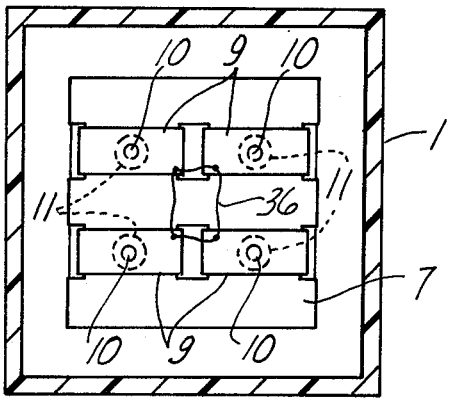
Fig-6
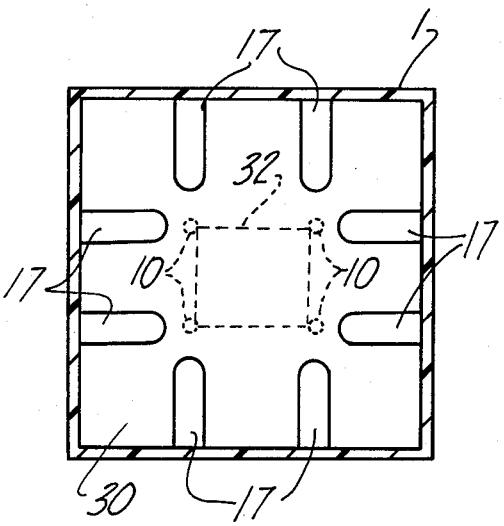
Fig-7
Fig-8
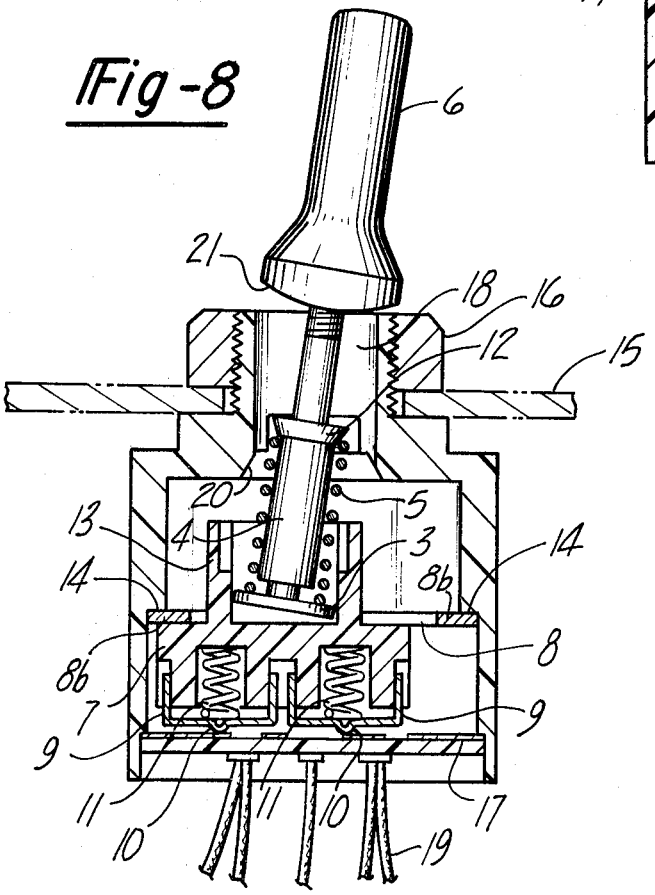

SWITCH HAVING UNIVERSAL TYPE ACTUATOR AND GUIDE PLATE

CROSS-REFERENCE TO RELATED APPLICATION

This application is a continuation-in-part of my application Ser. No. 565,001 filed Apr. 4, 1975 and now abandoned.

BACKGROUND OF THE INVENTION

This invention relates to switches and more particularly to a four-way lever switch.

SUMMARY OF THE INVENTION

This invention comprises a four-way lever switch including a housing provided within its upper portion with a vertical hole of a cruciform section connected with an outwardly tapered recess, and stationary contacts on its base, a movable block having an integrally formed hollow cube upon it and provided with movable contacts at its base, a rectangular guide plate mounted on the movable block and provided with an oblong plate mounted on the movable block and provided with an oblong aperture in which the hollow cube is movably inserted, and is movable only in the direction perpendicular to the aperture together with the movable block along shoulder abutments formed by inner walls of the housing, a shift lever protruding upward from the housing after passing through a flanged sleeve and vertical hole and provided at its inner end with a square plate inserted loosely in the hollow cube, and a coil spring arranged between the flange of the sleeve and square plate so as to push the flange against the bottom of the vertical hole and pull the knob attached to the outer end of the shift lever onto the top of said vertical hole.

This lever switch can occupy four different switching positions by moving the shift lever sidewise, forward and backward. The movements of the block carrying the movable contacts on the stationary contacts are correctly conducted by the guide plate whereby no disturbance in relative positions between the stationary and the movable contacts occurs. Upon release of the shift lever, it and its appertaining parts at once return to their neutral positions, so this switch is especially suitable for use where switching positions should be changed frequently at short intervals.

DESCRIPTION OF THE DRAWINGS

The invention will be further described by reference to the accompanying drawings.

FIG. 6 is a sectional view taken substantially along line VI—VI in FIG. 1;

FIG. 7 is a sectional view taken substantially along line VII—VII in FIG. 1;

FIG. 8 is a front view with partial sections similar to FIG. 1, but showing the switch in one actuated position.

DETAILED DESCRIPTION OF THE INVENTION

Figure 2:
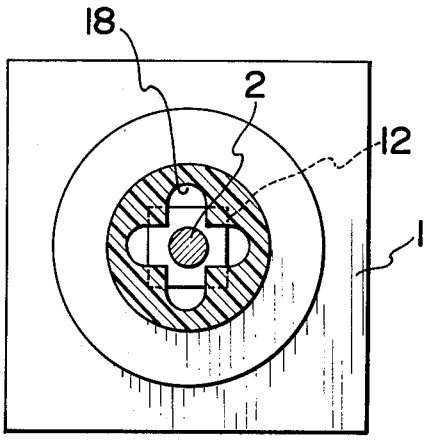
FIG. 2 is the sectional view along the line II—II of FIG. 1.
Figure 3:
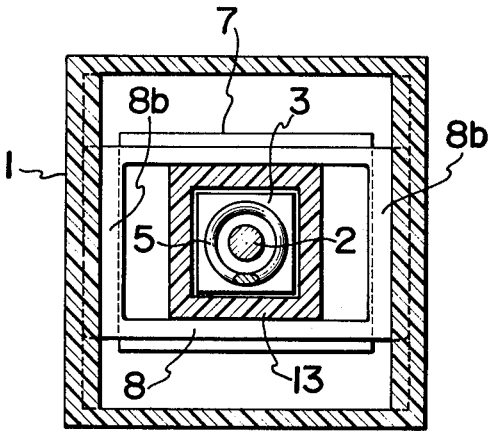
FIG. 3 is a sectional view along the line III—III of FIG. 1.

Referring now to the four-way switch shown in the drawings, a housing 1 is provided within its upper portion with a vertical hole 18 having a cruciform cross sectional shape (FIG. 2) connected with an outwardly tapered recess 20 open to the interior of the housing. The bottom of the housing 1 is enclosed by a base 30 having elongated stationary contacts 17 best shown in FIG. 7. The contacts can be formed either by printing or thin metal sheets and are arranged in spaced and parallel pairs with one pair of contacts 17 on each of the four sides of the base 30. The longitudinal axis of each contact 17 is perpendicular to its associated side of the base 30 and each contact 17 extends only partially across the base 30 thus leaving a square neutral zone 32 in the center of the base 30.

A movable block 7 has an integrally formed hollow cube 13 upon it and is provided with four movable contacts 10 at its base (FIG. 6). The contacts 10 are embossed from an angular metal piece 9 and are slidably received by recesses 34 in the bottom of the movable block 7. A spring 11 under compression is disposed between each contact 10 and the block 7 so that the contacts 10 remain in contact with the base 30. In addition, as shown in FIG. 6, the contacts 10 are electrically connected together by any appropriate means such as wires 36.

A rectangular guide plate 8 is mounted on the block 7. The guide plate 8 is provided with an aperture **8*a* in which the hollow cube 13 is movably inserted. The guide plate 8 is prevented from upward movement by the cooperation of abutting edges 8*b* of the guide plate 8 and shoulder abutments 14** formed by the inner walls of the housing.

A threaded shift lever 2 protrudes upwardly from the housing after passing through a sleeve 4 having an upper flange 12 and the vertical hole 18. A square plate 3 is secured across the inner end of the lever 2 and the plate 3 is loosely inserted into the hollow cube 13. A knob 6 is screwed onto the upper end of the shift lever 2. The bottom 21 of the knob 7 is spherical and abuts on the top of the housing 1 around the hole 18.

A coil spring 5 under compression is arranged between the flange 12 of the sleeve 4 and the square plate 3. The spring 5 thus forces the flange 12 against the bottom of the vertical hole 18 while simultaneously urging the knob 6 against the top of the housing 1 around the vertical hole 18. A cord 19 (some of which have been omitted from the drawing for clarity) is attached to each contact 17 and extends outwardly from the base 30.

This switch is adapted to be attached to a panel 15 by means of a nut 16.

Figure 1:
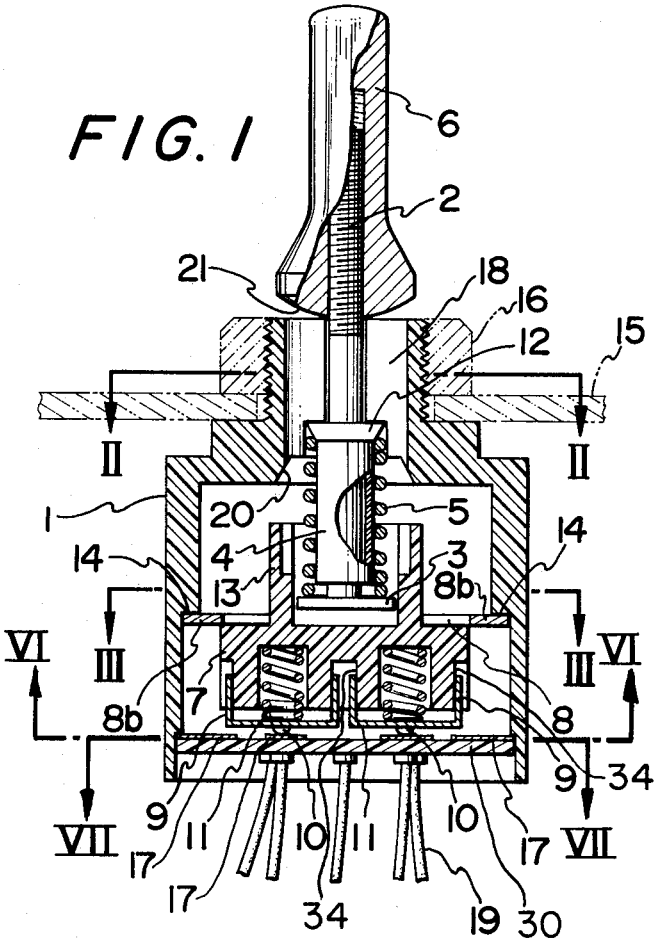
FIG. 1 is a front view with partial sections of the novel four-way lever switch according to this invention and showing the switch in a neutral position.
Figure 4:
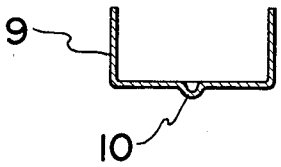
FIG. 4 is a sectional view of the movable contact.
Figure 5:
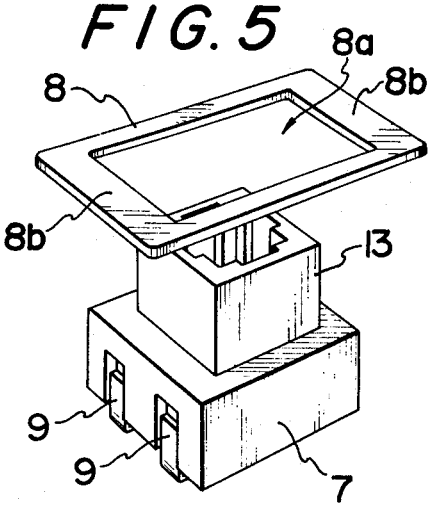
FIG. 5 shows the guide plate and the contact carrying block.

In operation, as shown in FIG. 1 the spring 5 maintains the lever 2 in a vertical position so that the movable contacts 10 remain in the neutral zone 32 (FIG. 7). When the shift lever 2 is moved sidewise in the hole 18, for example, to the right as shown in FIG. 8, the flange 12 abuts the housing 1 and acts as a fulcrum while the square plate 3 abuts the cube 13 and moves it leftward to the left switching position. In the left switching position two of the contacts 10 close the electrical circuit between the two left stationary contacts 17. During this leftward movement of the block 7, the hollow cube 13 slides leftward within the oblong aperture **8*a* while the guide plate 8 remains stationary. Simultaneously, the spherical surface 21 on the knob 6** slightly extends the shaft 2 outwardly from the housing 1 and further compresses the spring 5.

Upon release of the shift lever 2, it and its appertaining part, namely, the block 7 at once return to their neutral positions by the action of the spring 5.

When the shift lever 2 is moved in the direction perpendicular to the oblong aperture 8*a*, for example, to the forward direction against the action of the spring 5, the square plate 3 moves the block 7 backward so that the block 7 occupies the rear switching position. In this case, unlike before, the guide plate 8 moves along the shoulder 14 together with the block 7. Upon release of the shift lever 2, it and its appertaining parts, namely, block 7 and guide plate 8 return at once to their neutral positions by the action of the spring 5 in the already described manner.

As should be apparent from the foregoing, the switch according to this invention, can occupy four different switching positions by moving the shift lever 2 within the limits of the vertical hole 18 with its cruciform cross sectional shape. Moreover, upon release of the shift lever, it and its appertaining parts at once return to their neutral positions so that the movable contacts 10 do not contact the stationary contacts 17. Since the movements of the contact carrying block 7 are guided by the guide plate, the relative position between the stationary contacts 17 and the movable contacts 10 is maintained.

Further, if necessary, the tension of the spring 5 can be adjusted by rotating the knob 6. Rotation of the knob 6 axially shifts the lever 2 due to the threaded engagement between the knob 6 and lever 2 and varies the tension of the spring 5.

This novel four-way lever switch is adapted to be used as controller for automobile fender mirror adjusters, controller for electric signalling devices, controller for various electric toys or remote controller for radio controlled toy airplanes.

Having thus described my invention what is claimed is:

1. A lever switch comprising:

a housing having a vertical hole with a cruciform cross-sectional shape formed in its upper portion, said hole having an outwardly tapered recess;

a substantially square base secured to said housing, said base having a pair of stationary contacts formed along each side thereof;

a block having an integrally formed hollow cube formed on top of the block, said cube having a smaller cross-sectional area than said block whereby a pair of spaced and parallel abutment surfaces are formed on the top of the block along two opposite sides thereof;

said block being positioned within the housing and having movable contacts at its base adapted for selected engagement with the stationary contacts on the base of the housing; a rectangular guide plate having two short sides and two long sides and a rectangular oblong aperture formed therethrough, said hollow cube being positioned through said oblong aperture in said guide plate so that the bottom of the long sides of the guide plate abut against the abutment surfaces on said block whereby said guide plate permits said hollow cube to move longitudinally along said oblong aperture but prevents lateral movement of the cube;

the short sides of the guide plate being slidably received along shoulder abutments formed in said housing;

a shift lever protruding upward from said housing after passing through a flanged sleeve and the vertical hole and provided at its inner end with a square plate inserted loosely in said hollow cube and having a knob attached to its outer end; and a coil spring arranged between the flange of said sleeve and the square plate so as to push said flange against the bottom of the vertical hole and pull the knob attached to the outer end of said shift lever onto the top of said vertical hole;

whereby said shift lever is operable to both move said hollow cube along said oblong aperture in said guide plate to selectively make contact between the movable contacts on said block and the stationary contacts on two opposite sides of said base, and also to move the short sides of said guide plate along said housing shoulder surfaces so that said guide plate moves said cube to thereby selectively make contact between the movable contacts on said block and the stationary contacts on the other two sides of said base.

2. The invention as defined in claim 1 wherein said knob is provided with a lower spherical surface which abuts said housing whereby said knob pulls said lever outwardly from said housing as said lever is laterally moved within said vertical hole.

* * * * *